US008807570B1

(12) United States Patent
Zalar

(10) Patent No.: US 8,807,570 B1
(45) Date of Patent: Aug. 19, 2014

(54) SHOOTING TARGET

(76) Inventor: Robert John Zalar, Carmichaels, PA (US)

( * ) Notice: Subject to any disclaimer, the term of this patent is extended or adjusted under 35 U.S.C. 154(b) by 185 days.

(21) Appl. No.: 13/612,657

(22) Filed: Sep. 12, 2012

(51) Int. Cl.
*F41J 5/14* (2006.01)
*F41J 7/04* (2006.01)
*F41J 5/18* (2006.01)

(52) U.S. Cl.
CPC ..... *F41J 7/04* (2013.01); *F41J 5/18* (2013.01)
USPC ..... 273/390

(58) Field of Classification Search
USPC ..... 273/390, 388, 348, 378, 386, 387, 389, 273/391, 400, 401, 406, 407
See application file for complete search history.

(56) References Cited

U.S. PATENT DOCUMENTS

| | | | | | |
|---|---|---|---|---|---|
| 157,335 | A | * | 12/1874 | Lyon | 273/388 |
| 687,873 | A | | 12/1901 | Daniels | |
| 1,310,415 | A | | 7/1919 | Isberb | |
| 1,348,442 | A | * | 8/1920 | Prebble | 273/390 |
| 1,629,386 | A | * | 5/1927 | Hummerson | 273/390 |
| 1,733,606 | A | | 10/1929 | Junker | |
| 2,113,719 | A | * | 4/1938 | Creswell | 273/390 |
| 2,777,695 | A | | 1/1957 | Cohn | |
| 3,554,550 | A | | 1/1971 | Schram | |
| 4,116,443 | A | | 9/1978 | Dorfman | |
| 6,398,215 | B1 | | 6/2002 | Carroll | |
| 6,478,301 | B1 | * | 11/2002 | Witmeyer | 273/391 |
| 6,779,797 | B1 | | 8/2004 | Chou | |
| 6,994,348 | B2 | | 2/2006 | Lambert | |
| 6,994,349 | B2 | | 2/2006 | Lambert | |
| 7,052,012 | B2 | * | 5/2006 | Dehart | 273/406 |
| 7,303,192 | B2 | * | 12/2007 | Marshall et al. | 273/406 |
| 7,690,656 | B2 | | 4/2010 | Saunders | |
| 7,815,192 | B1 | * | 10/2010 | Kreiman et al. | 273/390 |
| 2006/0125185 | A1 | | 6/2006 | Rolfe | |
| 2013/0207347 | A1 | * | 8/2013 | Sovine | 273/390 |

* cited by examiner

*Primary Examiner* — Gene Kim
*Assistant Examiner* — M Chambers
(74) *Attorney, Agent, or Firm* — QuickPatents; Kevin Prince

(57) ABSTRACT

A target having at least one plate that includes a first side, a second side, and a peripheral edge that has a top and a bottom, through which a rotational shaft projects along a vertical rotational axis. The first side of the plate is visually distinct from the second side of the plate. A frame rotationally captures each plate at both a bottom shaft receiver and a top shaft receiver. A ramp projects away from a rear side of the frame proximate each bottom shaft receiver, such that with the first side of the plate facing in a forward direction, a projectile striking the plate not along the rotational axis causes the plate rotate to contact the ramp, lifting the plate and the rotational shaft within the shaft receivers to flip the plate so that the second side of the plate is facing in the forward direction.

17 Claims, 3 Drawing Sheets

SHOOTING TARGET

STATEMENT REGARDING FEDERALLY SPONSORED RESEARCH AND DEVELOPMENT

Not Applicable.

FIELD OF THE INVENTION

This invention relates to targets, and more particularly to a shooting target game.

DISCUSSION OF RELATED ART

Generally, a target device is an object used for aiming during shooting or archery practice. Targets are typically made of paper, corrugated plastic, or other material capable of withstanding an impact force and/or identifying the location of a shot. Most competitive target devices include one or more scoring rings or sections which allow for competitive shooting, with a center area called the 'Bull's-eye.' Targets allow shooters to improve their skills by quickly being able to compare their aiming point to where the bullet actually impacted the target.

U.S. Pat. No. 1,733,606 to Junker on Oct. 29, 1929, teaches the structural characteristics of a target game employing a plurality of targets, and so constructed that the striking of a target is visibly and audibly apparent. The targets are disposed in an upright position and secured in that position until struck, at which point the target falls until stopped by a back rod. The stopping rod also allows for the struck targets to be re-established when cables connected to the rods are pulled. While Junker teaches a target apparatus capable of providing audible and visible feedback, it does not satisfy the need for a target system that can be shot at continuously without having to manually reset the targets.

U.S. Pat. No. 6,779,797 to Chou on Aug. 24, 2004, teaches a target machine having a restoring function and a rotation positioning function. When the target is struck, the target is pivoted downward and locked by a respective push member, thereby preventing the target from being returned to the original position due to excessive hitting force of the projectile. The target can be returned to the original position by the pull of a lever. While Chou teaches a target machine capable of restoring the targets and utilizing rotational positioning, it does not satisfy the need for automatic restoration of targets.

Targets for shooting games are also known in the art, and there are several prior art targets that provide for a competitive game to see which of two shooters is able to "knock down" his targets first. Such a device is taught in US Patent Application 2006/0125185 to Rolfe on Jun. 15, 2006, wherein knocking down one's target resets an associated competitor's target. Such a device, while resulting in a fun and competitive game, is bulky and takes a considerable amount of space. Further, the person assigned to knocking down the upper-most target has the advantage of gravity on his side, since hitting the lower targets requires the projectile having to act against gravity. Further, the targets in such a device are necessarily in different places for each shooter, wherein one shooter may have a positional advantage over the other due to environmental effects such as sunlight reflections, shadows, or the like.

U.S. Pat. No. 6,398,215 to Carroll on Jun. 4, 2002 has many of the same drawbacks, as does U.S. Pat. No. 6,994,348 to Lambert et al. on Feb. 7, 2006, and U.S. Pat. No. 7,690,656 to Saunders on Apr. 6, 2010. Such prior art devices necessarily have a large area between the targets that is unproductive for the shooters to hit, and results in a low target surface area for a given total target area. Hitting such areas of a target that are not intended to be hit can result in increased damage to the device during use. Further, such devices only provide for a fixed force required to move a target from one side to the other, such force not being adjustable as appropriate for the type of projectile being used. That is to say, the same force is required to actuate the targets in such device, whether the targets are being shot with BBs or .40 caliber bullets.

Therefore, there is a need for a device that provides for a fun, competitive shooting game for two players or two teams of players, and that has a high target to non-target surface area ratio. Actuation of the targets of such a needed device would be adjustable based on the type of projectile being shot at the targets. Further, the targets of such a needed invention would remain in the same place for each shooter, regardless of which side of the target plates are facing forward, making the conditions for each shooter more consistent. The present invention accomplishes these objectives.

SUMMARY OF THE INVENTION

The present device is a target having at least one plate that includes a first side, a second side, and a peripheral edge. The peripheral edge of each plate has a top and a bottom, through which is defined a vertical rotational axis. A rotational shaft projects away from both the top and the bottom along the vertical rotational axis. The first side of the plate is visually distinct from the second side of the plate, such as by having applied thereto a distinct color, pattern, indicia, or the like.

A frame is adapted for rotationally capturing each plate at both a bottom shaft receiver and a top shaft receiver. Each receiver receives the rotational shaft of the plate therein. A stand may be included for supporting the frame on a horizontal surface.

A ramp projects away from a rear side of the frame proximate the bottom shaft receiver, preferably at between a 30 and 60 degree angle with respect to the frame. The ramp, in a preferred embodiment, is a U-shaped rod bent and fixed with the rear side of the frame, such as by welding.

In use, with the first side of the plate facing in a forward direction, a projectile such as a bullet may be fired towards the plate such that if the projectile strikes the plate not along the rotational axis, the plate rotates to contact the ramp, lifting the plate and the rotational shaft within the shaft receivers to flip the plate so that the second side of the plate is facing in the forward direction.

In one embodiment, the at least one plate further includes a pair of fins projecting orthogonally away from both the first and second sides of the plate along the vertical rotational axis, such that if the plate comes to rest at the top of the ramp, either of the fins may be hit with the projectile to flip either the first or second side of the plate to face in the forward direction.

In embodiments having a plurality of the plates, the frame includes one bottom shaft receiver and one top shaft receiver, and one ramp for each plate. In a preferred embodiment, the plurality of the plates is exactly five of the plates forming an X-shaped pattern. Alternately, the plurality of the plates is exactly nine of the plates forming a three-by-three tick-tac-toe grid. In such embodiments, a game may be played by two players or two teams wherein the first player or team to achieve a line of three plates having the same side of the plate facing forward wins the game. In such a game, the plates may each be placed initially at the top of each ramp, such that to have any one of the plates "in play" with either its front side or rear side facing forward, the player must hit one of the fins.

The present invention provides for a fun, competitive shooting game for two players or two teams of players, and has a relatively high target to non-target surface area ratio. Actuation of the targets is adjustable based on the type of projectile being shot at the targets. Further, the targets of such a needed invention remain in the same place for each shooter, regardless of which side of the target plates are facing forward, making the conditions for each shooter more consistent. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. Finally, herein the word "each" may be used in reference to an item that has only a single instance, and does not necessarily connote a plurality of the items.

Figure 1:
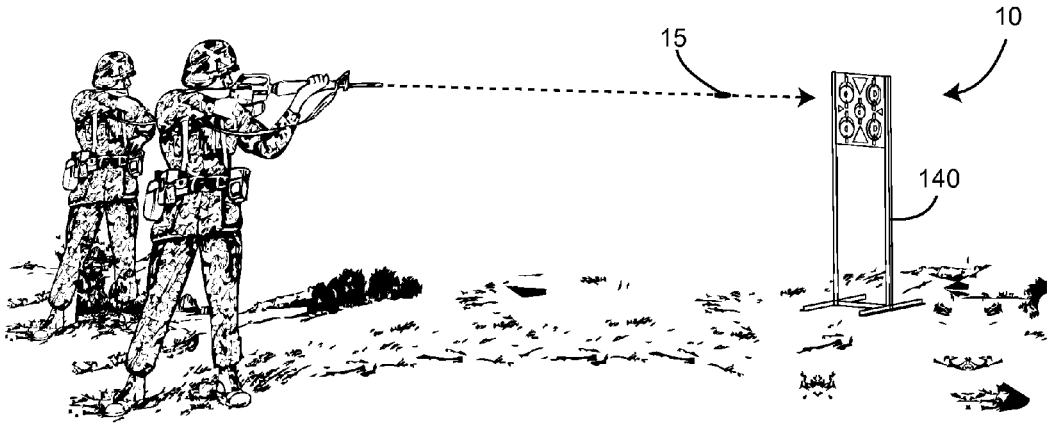
FIG. 1 is a perspective view of the invention, illustrated while in-use.
Figure 2:
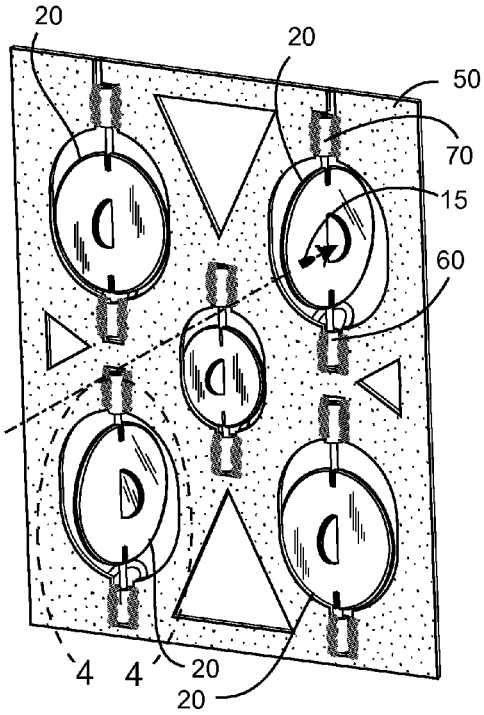
FIG. 2 is a perspective view of the invention.
Figure 3:
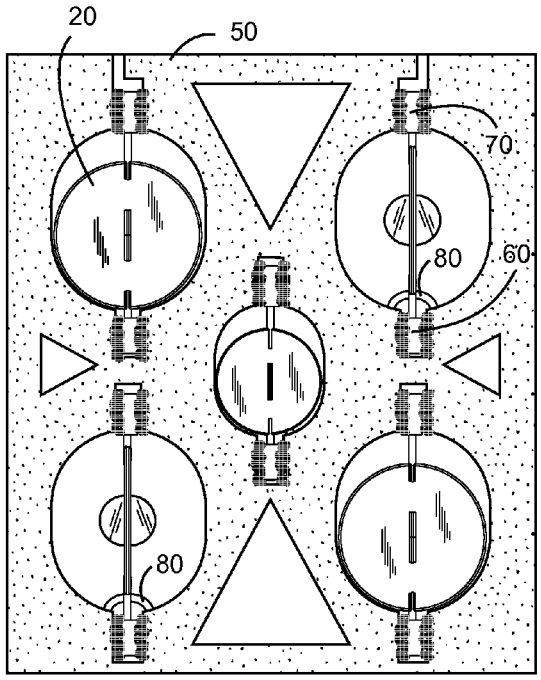
FIG. 3 is a front elevational view of the invention.

FIGS. 1 and 2 illustrate a target device 10 having at least one plate 20 that includes a first side 22, a second side 28, and a peripheral edge 25. The peripheral edge 25 of each plate 20 has a top 29 and a bottom 21, through which is defined a vertical rotational axis 30. A rotational shaft 40 projects away from both the top 29 and the bottom 21 along the vertical rotational axis 30. The first side 22 of the plate 20 is visually distinct from the second side 28 of the plate 20, such as by having applied thereto a distinct color, pattern, indicia 120, 130, or the like.

Each plate 20 is preferably made from a strong sheet metal material, such as stainless steel, and is preferably formed in a shape such as a circle, oval, rectangle, square, star, or the like. Further, in embodiments of the invention having a plurality of the plates 20, all of the plates 20 may be the same shape and size, or the plates 20 may vary in either size (FIG. 6) or shape (not shown).

A frame 50 is adapted for rotationally capturing the at least one plate 20 at both a bottom shaft receiver 60 and a top shaft receiver 70. Each receiver 60,70 receives the rotational shaft 40 of the plate 20 therein, acting as a bushing for the rotational shaft 40. The frame 50 is preferably made from a strong sheet metal material, such as stainless steel. A stand 140 may be included for supporting the frame 50 on a horizontal surface (FIG. 1).

A ramp 80 projects away from a rear side 58 of the frame 50 proximate the bottom shaft receiver 60, preferably at between a 30 and 60 degree angle with respect to the frame 50. The ramp 80, in a preferred embodiment, is a U-shaped rod 81 bent and fixed with the rear side 58 of the frame 50, such as by welding.

In use, with the first side 22 of the plate 20 facing in a forward direction, a projectile 15 such as a bullet may be fired towards the plate 20 such that if the projectile 15 strikes the plate 20 not along the rotational axis 30, the plate 20 rotates to contact the ramp 80, lifting the plate 20 and the rotational shaft 40 within the shaft receivers 60,70 to flip the plate 20 so that the second side 28 of the plate is facing in the forward direction.

Figure 4:
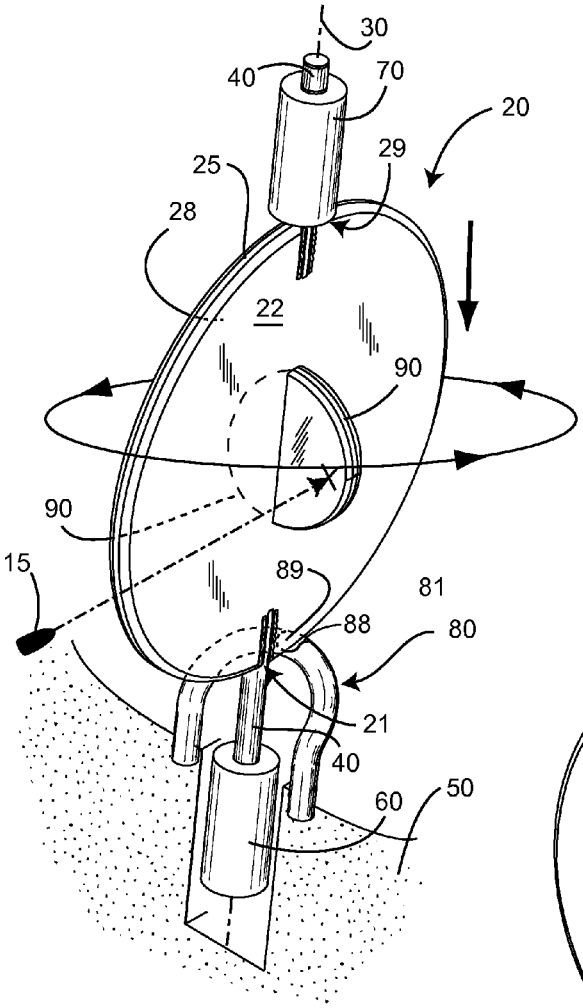
FIG. 4 is a perspective view of one embodiment of a target plate of the invention.

In one embodiment, the at least one plate 20 further includes a pair of fins 90 projecting orthogonally away from both the first and second sides 22,28 of the plate 20 along the vertical rotational axis 30, such that if the plate 20 comes to rest at the top 89 of the ramp 80, either of the fins 90 may be hit with the projectile 15 to flip either the first or second side 22,28 of the plate 20 to face in the forward direction. In one embodiment, illustrated in FIGS. 4 and 5, a groove 88 may be formed at the top 89 of the ramp 80 to better hold the plate 20 in a neutral position, with neither the first side 22 or the second side 28 of the plate 20 facing forward, such as at the start of playing a game of "three-in-a-row" as described below.

Figure 5:
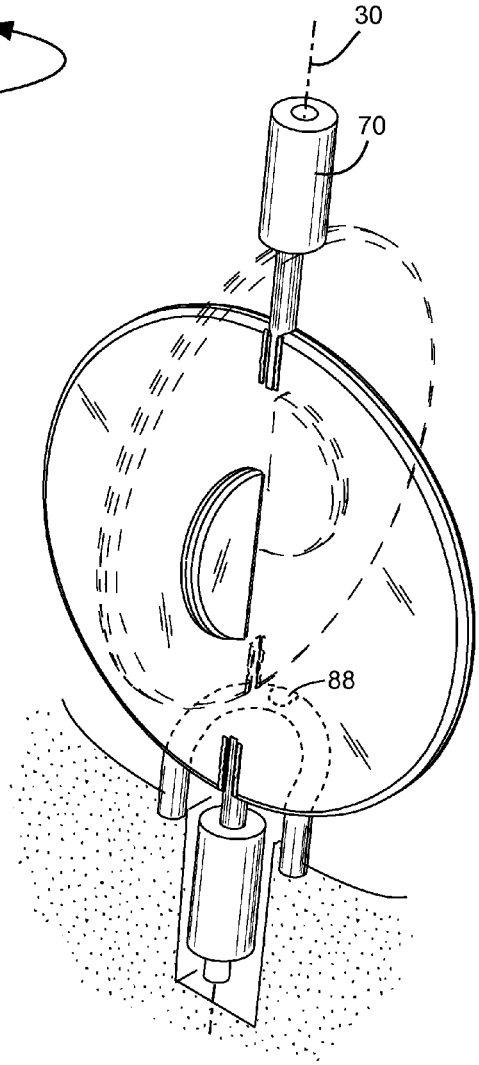
FIG. 5 is a perspective view of FIG. 4 in an alternate configuration.
Figure 6:
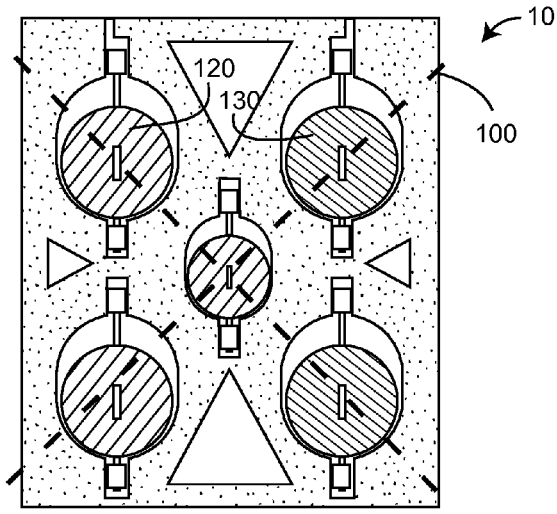
FIG. 6 is a front elevational view of one embodiment of the invention.
Figure 7:
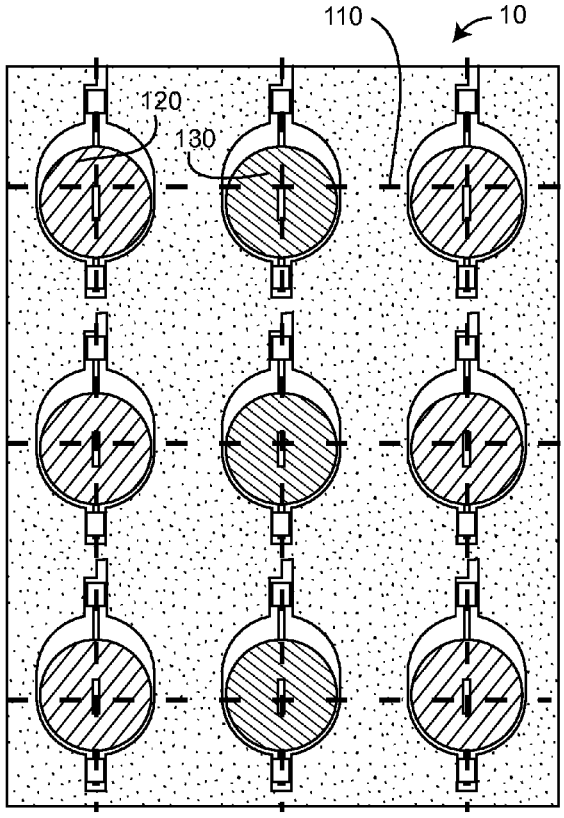
FIG. 7 is a front elevational view of an alternate embodiment of the invention.
Figure 8:
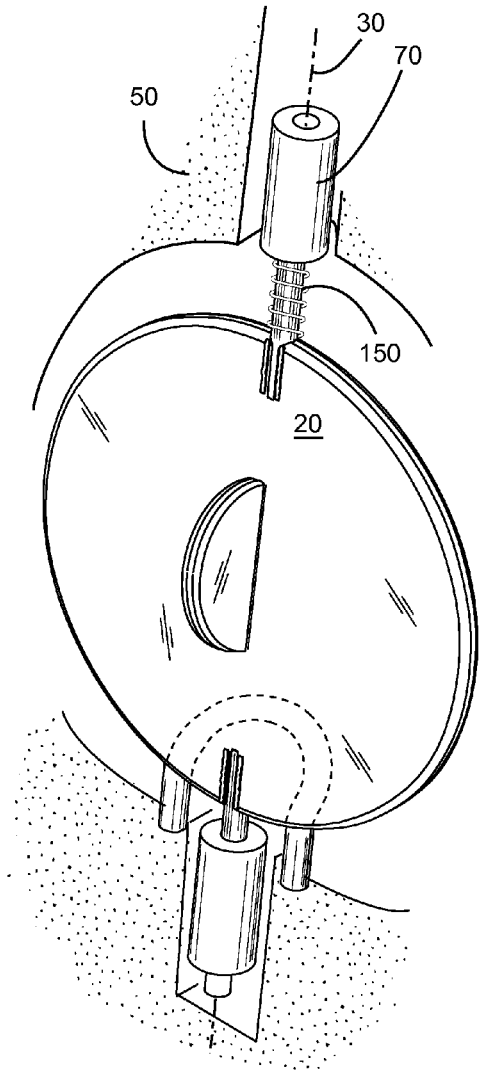
FIG. 8 is a perspective view of an alternate embodiment of a target plate of the invention.

In embodiments having a plurality of the plates 20, the frame 50 includes one bottom shaft receiver 60 and one top shaft receiver 70, and one ramp 80 for each plate 80. In a preferred embodiment, the plurality of the plates 20 is exactly five of the plates 20 forming an X-shaped pattern 100 (FIG. 6). Alternately, the plurality of the plates 20 is exactly nine of the plates 20 forming a three-by-three tick-tac-toe grid 110 (FIG. 7). In such embodiments, a game may be played by two players or two teams wherein the first player or team to achieve a line of three plates 20 having the same side 22,28 of the plate 20 facing forward wins the game. In such a game, the plates 20 may each be placed initially at the top 89 of each ramp 80 (FIG. 4), such that to have any one of the plates 20 "in play" with either its front side 22 or rear side 28 facing forward, the player must hit one of the fins 90 (FIG. 5).

In one embodiment, the top shaft receiver 70 includes a coil spring 150 for applying downward tension to the rotational shaft 40 of the plate 20, such that the rotational force necessary to flip the plate 20 over the ramp 80 is increased. In such an embodiment, the tension on the coil spring 150 is adjustable by selection of a thinner or thicker coil spring 70.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A target device comprising:

at least one plate having a first side, a second side, and a peripheral edge, the peripheral edge having a top and a bottom through which is defined a vertical rotational axis, a rotational shaft projecting away from both the top and the bottom along the vertical rotational axis, the first side of the plate being visually distinct from the second side of the plate;

a frame adapted for rotationally capturing the at least one plate at both a bottom shaft receiver and a top shaft receiver, each receiver receiving the rotational shaft of the plate therein, a ramp projecting away from a rear side of the frame proximate the bottom shaft receiver;

whereby with the first side of the plate facing in a forward direction, a projectile may be projected towards the plate such that if the projectile strikes the plate not along the rotational axis, the plate rotates to contact the ramp, lifting the plate and the rotational shaft within the shaft receivers to flip the plate so that the second side of the plate is facing in the forward direction and wherein the ramp is a U-shaped rod.

2. The target device of claim 1 wherein the at least one plate is a plurality of the plates, the frame including one bottom shaft receiver, one top shaft receiver, and one ramp for each plate.

3. The target device of claim 2 wherein the plurality of the plates is exactly five of the plates forming an X-shaped pattern.

4. The target device of claim 2 wherein the plurality of the plates is exactly nine of the plates forming a three-by-three tic-tac-toe grid.

5. The target device of claim 2 wherein the plurality of the plates are all the same shape and size.

6. The target device of claim 2 wherein the plurality of the plates include at least two plates having different sizes.

7. The target device of claim 2 wherein the plurality of the plates includes at least two plates having different shapes.

8. The target device of claim 2 wherein the first side of the plurality of the plates are all visually similar, and wherein the second side of the plurality of the plates are all visually similar but visually distinct from the first side of the plurality of the plates.

9. The target device of claim 2 wherein the first side of each of the plurality of the plates includes a first indicia, and wherein the second side of each of the plurality of the plates includes a second indicia, the first and second indicia being visually distinct.

10. The target device of claim 1 wherein the ramp projects upward from the bottom receiver of the frame at between a 30 and 60 degree angle with respect to the frame.

11. The target device of claim 1 wherein the at least one plate further includes a pair of fins projected orthogonally away from both the first and second sides of the plate along the vertical rotational axis, whereby if the plate comes to rest at the top of the ramp, either of the fins may be hit with the projectile to flip either the first or second side of the plate to face in the forward direction.

12. The target device of claim 1 wherein the at least one plate is circular.

13. The target device of claim 1 wherein the at least one plate is rectangular.

14. The target device of claim 1 wherein the frame and the at least one plate are formed from a metal sheet material.

15. The target device of claim 1 wherein the frame further includes a stand for supporting the frame upon a horizontal surface.

16. The target device of claim 1 wherein the top shaft receiver includes a coil spring for applying downward force to the rotational shaft of the plate, whereby the rotational force necessary to flip the plate over the ramp is increased.

17. The target device of claim 1 wherein a groove is formed at a top of the U-shaped rod for temporary holding of the plate in a neutral position.

* * * * *